US006390726B1

(12) United States Patent
Guntert et al.

(10) Patent No.: US 6,390,726 B1
(45) Date of Patent: May 21, 2002

(54) DOWEL BAR INSERTER KIT HAVING CHAIN FEEDER

(75) Inventors: Ronald M. Guntert, Stockton; Gerald Lee Dahlinger, Ripon; Richard W. Francis, Stockton, all of CA (US)

(73) Assignee: Guntert & Zimmerman Const. Div., Ripon, CA (US)

( * ) Notice: Subject to any disclaimer, the term of this patent is extended or adjusted under 35 U.S.C. 154(b) by 0 days.

(21) Appl. No.: 09/411,744

(22) Filed: Oct. 1, 1999

(51) Int. Cl.[7] ..... E01C 23/02

(52) U.S. Cl. ..... 404/88; 404/100

(58) Field of Search ..... 404/52, 62, 72, 404/75, 87, 88, 100

(56) References Cited

U.S. PATENT DOCUMENTS

| | | | | | |
|---|---|---|---|---|---|
| 4,493,584 | A | | 1/1985 | Guntert | |
| 5,135,333 | A | | 8/1992 | Guntert et al. | |
| 5,190,397 | A | * | 3/1993 | Bengford et al. | 404/88 |
| 5,209,602 | A | * | 5/1993 | Godbersen | 404/88 |
| 5,273,374 | A | * | 12/1993 | Thoma et al. | 404/88 |
| 5,405,212 | A | * | 4/1995 | Swisher, Jr. et al. | 404/74 |
| 5,590,977 | A | | 1/1997 | Guntert et al. | |
| 5,615,972 | A | | 4/1997 | Guntert et al. | |
| 5,647,688 | A | | 7/1997 | Guntert et al. | |
| 5,924,817 | A | | 7/1999 | Godbersen | |
| 5,941,658 | A | * | 8/1999 | Dahlinger et al. | 404/84.1 |
| 5,941,659 | A | * | 8/1999 | Godbersen | 404/88 |
| 6,099,204 | A | * | 8/2000 | Godbersen | 404/88 |

FOREIGN PATENT DOCUMENTS

DE 19904797 12/2000

OTHER PUBLICATIONS

RexCon Concrete Batch Plants and Controls, "Model S Batch Plant," www.rexcon.com/products/english/e_batch/e_models.html., Apr. 9. 1999, 2 pgs description, 2 pgs. pictures.

Erie Strayer Co., MG–11C Central Mix Batching Plants, "Mobile Gravity 11 Central Mix," Bulletin No. MG11C89, Feb. 1989.

Erie Strayer Co., Sentry/Scout Batching Control System, "Fast, Accurate, Reliable Batching Control Systems," Bulletin No. CP, Mar. 1999.

(List continued on next page.)

*Primary Examiner*—Gary S. Hartmann
(74) *Attorney, Agent, or Firm*—William Michael Hynes; Townsend and Townsend and Crew LLP

(57) ABSTRACT

In combination with a slipform paver, a new chain feeder is disclosed which is contained within the profile of a slipform paver. The chain feeder is used in combination with a plurality of dowel bar inserter stations. A single file dowel bar path is provided immediately above the plurality of dowel bar inserter stations overlying an upper dowel bar shuttle for each inserter station. The feeder includes a plurality of feeding lugs for pushing dowel bars along the single file dowel bar path parallel to openings in the upper dowel bar shuttle. This enables dowel bars to fall into the upper dowel bar shuttle until all inserter stations are loaded with dowel bars. When the dowel bars are inserted, the upper dowel bar shuttle moves relative to the lower dowel bar shuttle. This permits an upper shuttle bar opening in the upper dowel bar shuttle and the lower shuttle bar opening in the lower dowel bar shuttle to move into registration one with another. Dowel bars fall from the upper shuttle bar opening in the upper dowel bar shuttle into the lower shuttle bar opening of the lower dowel bar shuttle through a pan opening in the dowel bar inserter pan and on to a slab formed beneath the dowel bar inserter pan. Thereafter, the dowel bar inserters place the dowel bars centrally of the recently slipformed slab.

14 Claims, 10 Drawing Sheets

OTHER PUBLICATIONS

Erie Strayer Co., "Mobile Gravity and Central Mix Plant," Drawing No. 4A–219801, Jan. 7, 1991.

Erie Strayer Co., "Mobile Gravity, Central Mix Plant with Conc. Directional Chute," Drawing No. 4A–219802, Jan. 7, 1991.

Vince Hagan Co., "Super Haganator, 'Mobile Paver' Central Mix Concrete Plant System (2 to 12 cubic yards)," Bulletin 109, Nov. 15, 1977.

Vince Hagan Co., "10 Yard Central Mix Plant," Drawing No. S228, Apr. 20, 1982.

Heltzel Steel Form & Iron Co., "Self–Erect Mobile Central–Mix Batching Plants and Mobile Mixers," Bulletin No. 66–70R.

Johnson–Ross Concrete Plants, "Ranger 750," Bulletin No. 750–098.

* cited by examiner

DOWEL BAR INSERTER KIT HAVING CHAIN FEEDER

This invention relates to so-called slip form pavers having dowel bar inserters. More particularly, this disclosure sets for a chain feeder for a dowel bar inserter, which is contained within the transport profile of the slip form paver. This containment within the transport profile enables the dowel bar feeder to cycle once insertion has commenced and does not require unnecessary bolster extension.

BACKGROUND OF THE INVENTION

Concrete slipform pavers are known. Specifically, such pavers include a "tractor" and a "paving kit".

Regarding the tractor, most concrete slipform pavers include a tractor, which is comprised of a rectilinear frame. This rectilinear frame has bolsters extending parallel to the direction of machine travel and cross beams extending across the paved roadway. The rectilinear frame thus straddles the concrete roadway or runway while it is paved. This frame is propelled and supported on either end by side crawler track(s). The frame supports a diesel engine driven hydraulic power unit, which supplies power to the tractor and paving kit.

The paving kit is typically suspended below the rectilinear tractor frame by mechanical means. The paving kit takes its hydraulic power from the power unit on the tractor. The tractor and paving kit comprise the slipform. This slipform passes over concrete placed in its path. The concrete is placed in a relatively even and level mass that can be conveniently paved. During this slipform process the tractor attached paving kit spreads the concrete dumped in the path of the paver, levels and vibrates it into a semi-liquid state, then confines and finishes the concrete into a slab with an upwardly exposed and finished surface. Sideforms mounted to the side of the slipformn kit confine the sides of the slab during the paving process.

The tractor typically has either two or four crawler tracks supporting and propelling the frame and attached paving kit. Other kits can be attached to these tractors such as kits for conveying and spreading concrete and trimming and spreading base materials. For the purposes of this description, we will focus on the paving kit working in conjunction with a rear mounted, dowel bar inserter kit used for slipforming a concrete slab and concurrently inserting dowel bars in the plastic concrete across the slipform paved slab.

Dowel bar and tie bar inserters for such paving machines are known. Dowel bars are placed parallel to the direction of machine travel and ties bars are placed across the direction of machine travel. Specifically, three types of inserters for such bars are known. First, there is the tie bar inserter for the edge of the slab. This tie bar is placed transverse to the paving direction and enables tying of sequentially placed side-by-side slabs, one to another. This type of tie bar and tie bar inserter is not of concern here.

Second, there is the tie bar inserter for placing tie bars completely within the placed slab. A placed slab might be a two or more 12' (3.657 mm) wide lane being placed concurrently in one pass. These tie bars are placed in a line transverse to the direction of machine travel. These tie bars enable a joint to be subsequently cut in the middle of the slab parallel to the direction of machine travel. Expansion of the slab across the dimension of machine travel is permitted. This type of tie bar and dowel bar inserter is not of concern here.

Finally, and the most difficult insertion problem is the dowel bar inserter for placing dowel bars parallel to the direction of machine travel. The dowel bars are simultaneously placed in a line (or row) on what are typically 12" (305 mm) centers, across the entire slab being slipformed by the paver. These dowel bars enable a joint to be subsequently cut in the slab across the direction of machine travel. The dowels provide load transfer between the adjoining panels in the direction of machine travel.

This type of dowel bar inserter presents the most difficult insertion problem in any slipform paver. Additionally, this type of dowel bar inserter requires modification to be made to the slipform paver to attach the dowel bar inserter. In addition to this, great effort is required to attach or remove the dowel bar inserter from the slipform paver. It might take an additional two days to assemble a machine with a dowel bar inserter. This great effort has limited the dowel bar inserter's acceptance on smaller paving jobs. In what follows, we first discuss the most modern pavers, which have been developed. Second, we turn to the prior art problem of dowel bar insertion. Third, we set forth the mechanical problem of attachment and removal of dowel bar inserters to known pavers, including the pavers summarized above.

In Guntert et al U.S. Pat. No. 5,590,977 issued Jan. 7, 1997 entitled Four Track Paving Machine and Process of Transport we have disclosed a portable slip form paver that used telescoping members in the direction of machine travel. A four track paver is disclosed having a frame which telescopes for transport to reduce the dimension of the machine in the direction of paving machine travel. A rectilinear tractor frame is provided. The frame includes four crawler tracks, one connected to each corner of the frame via a side bolster. The crawler tracks are directly supported on a hydraulic cylinder and mounted for pivotal movement about the vertical axis of the hydraulic cylinder. The frame telescopes at side bolsters between the leading and trailing crawler tracks at the sides of the machine. When expanded, the paving machine has the full dimension required for paving. When contracted, the paving machine has a profile allowing convenient transport. Most importantly, such expansion and contraction of the machine in the direction of paving travel does not require substantial paver or paver kit disassembly. As a consequence, a convenient method of loading and off loading to a hauling flatbed trailer exists. With the frame contracted at the side bolsters and the tracks pivoted parallel to the pavement spanning dimension of the frame, both frame and paving kit are elevated and a transporting flatbed trailer moved under the paver. Supports are installed to relieve the slipform paving kit from the fall weight of the tractor frame, and the tracks lifted. There results a four track paver profile transportable within a maximum width envelope which can be legally transported on the highway without a pilot car (in the U.S.A. this is 12' or (3.657 M.) This patent is incorporated by reference to this disclosure as if set forth in full.

In Guntert et al U.S. Pat. No. 5,615,972 issued Apr. 1, 1997 entitled Paving Machine with Extended Telescoping Members (see also U.S. Pat. No. 5,647,688) we have disclosed a portable slip form paver having an extendable width. A conventional telescoping frame on a paving tractor is provided with fixed frame cross beam extension members for insertion to and attachment with a telescoping frame member. The conventional telescoping frame includes paired forward and paired rear side-by-side female tube members. Each forward and rear tube member conventionally acts for the telescoping support of male extension members which attach directly to the side bolster, which in turn attaches to the hydraulic jacking columns and crawlers.

Within the limits of expansion, the male extension members co-acting with clamps acting through the female tube members provide for both movement of the point of crawler support and expansion of the paving width of the tractor frame. Into this combination, extenders are added for attachment to the supported end of the male extension members interior of the female telescoping members. During frame width expansion, the male telescoping members are expanded to register their ends interior of the female telescoping members to attachment access ports in the female telescoping member. The extenders are inserted, supported, and registered at complimentary attachment apertures with attachment to the male telescoping members taking place. Once attachment has occurred, further extension of the male telescoping members occurs. A simple system of pinned cross bracing reinforces the extended frame with relatively light bracing members. When the telescoping members at both sides of the frame are provided with the extenders to extend the telescoping span of the paver, a tractor of greater expansion and range of expansion capability is provided. This width expansion obviates the need for fixed frame extensions, and permits frame expansion without heavy lifting equipment. This patent is incorporated by reference to this disclosure as if set forth in full.

Machines built to the specification of the above referenced patents require dowel bar inserters from time to time. Regarding such dowel bar insertion, the dowel bars must be placed parallel to the direction of machine travel. A line of dowel bars must be simultaneously inserted across the slab being formed. Typically, 12 to 34 or more such dowel bars can be inserted depending upon the width of pavement being paved. Center to center spacing of insertion between the dowel bars can vary. Variation can occur from about 12 inches (305 mm) on typical highway paving up to 18 inches (457 mm) for certain airport runways, aprons and taxiways. All such dowel bars must be inserted simultaneously by a mechanism, which remains is stationary with respect to the plastic concrete slab being continuously formed. Thus, the dowel bar inserter must be on rails, which permit dowel bar inserter travel in the direction of concrete placement by the machine.

Dowel bars are placed at relatively short intervals along the direction of machine travel—in the order of every 15 feet (4.57 M) of machine travel. Slipform pavers operate at speeds up to 15 feet per minute or more at times. It must be remembered that the individual dowel bars must be separately loaded at each insertion station between dowel bar insertions. In the prior art, such loading has occurred by a cart traveling across the empty dowel bar insertion stations located directly over a dowel bar inserter confining pan, which slides a top a recently formed slab. This cart has produced at least four difficulties in the past.

First, the cart may contains stacked bars or at least bars rolling against each other. As the stacked (or touching) bars are pulled across empty dowel bar insertion stations, the individual dowel bars drop into the stations. This dropping is not always uniform because of the contact between bars. For example, it is known to have one end of the bar drop from the car with the other end of the bar remaining in the cart. When such partial dropping of the bar occurs, the cart is jammed in its path of travel across the slab. Paving must stop until such jams are cleared.

Second, the cart must first distribute all the bars across the slab at a first and a lower speed (to prevent jamming) and then return to the loading side of the machine at a speed before insertion of the dowel bars into the slab can occur. Once the cart is out of the way of the insertion forks at the side of the paver, dowel bar insertion can occur with the inserters remaining stationary with respect to the slab. While the cart is in the process of returning from its distribution of dowel bars, no insertion of the distributed bars can occur.

Third, the cart protrudes from the side of the paver as the first insertion fork can be located as close as 6" (15 cm) from the edge of pavement. Such protrusion must not interfere with the tracks. This being the case, the length of the bolster between tracks must be increased to accommodate that extra spatial interval required by the cart or the entire crawler track must be moved away from edge of pavement so the cart can clear the track. Furthermore, the protrusion of the cart and track for the cart from the side of the paver constitutes an obstruction to the side of the paver. Articles, such as fire hydrants or street light poles, close to the paving path of the paver must be removed. Such removal increases paving time and expense.

Fourth, the width of the cart—exceeding the length of the dowel bars—must be added to the path traveled by the dowel bar inserters during the required placement of the dowel bars to the slab. This means that the length of the dowel bar inserter in the direction of machine travel must be increased. Taking the case of a four track paver, the distance of the bolster extending in the direction of machine travel must be increased.

Placement of dowel bar inserters on existing pavers has also caused difficulty. To place such inserters on a conventional paver, substantial machine disassembly and modification must occur. First, the trailing finishing pan must be removed. Second, the conventional bolsters must be modified and extensions added to allow room in front of the rear crawler track to make room for the dowel bar inserter to work. These bolster extensions also support the dowel bar inserter kit. Third, because the rear crawler tracks have been moved back, a cross beam must be added between the rear bolsters to prevent the extended bolsters from twisting under load. Fourth, an optional spreader plow for the correcting beam must be added. Fifth, a correcting beam—the beam that establishes the final slab grade from the paver, after the dowel bar inserter inserts the bars—must be added. Thereafter, the trailing finishing pan is reattached behind the correcting beam. To fit these required pieces of the dowel bar inserter between the rear of the slipform conforming pan and ahead of the rear crawler track can increase the center to center distance between the front and rear crawler tracks by 20' (6.10 M). The dowel bar inserter and its related attachments also necessitates two additional trucks to haul it.

This process of attachment of dowel bar inserters is sufficiently complex, that for relatively small paving jobs, dowel bar inserters are not used. Instead, such dowel bars are tied together and support on "baskets" or "chairs" and secured to the subgrade ahead of the slipform. The baskets hold the dowels in position at the center of the slab. Although, these dowel baskets assemblies are significantly more expensive than loose dowels and require significant labor to install the extra mobilization and transport cost of paver with a dowel bar inserter outweighs this extra cost on a small job.

SUMMARY OF THE INVENTION

In combination with a slipformn paver, a new chain feeder is disclosed which is contained within the profile of a slipform paver and enables improved cycling time for the insertion of dowel bars. The chain feeder is used in combination with a plurality of dowel bar inserter stations. Each dowel bar insertion station includes an upper dowel bar shuttle with an upper shuttle bar opening for receiving a dowel bar and a lower dowel bar shuttle with a lower shuttle bar opening for permitting a dowel bar to fall through the lower dowel bar shuttle. A dowel bar inserter pan supports the lower dowel bar shuttle and defines a pan opening for permitting dowel bars inserted to the lower dowel bar shuttle to fall through the pan opening. A single file dowel bar path is provided immediately above the plurality of dowel bar inserter stations overlying the upper dowel bar shuttle for each inserter station. The feeder includes a plurality of feeding lugs for pushing dowel bars along the single file dowel bar path parallel to openings in the upper dowel bar shuttle. This enables dowel bars to fall into the upper dowel bar shuttle when the upper dowel bar shuttle is empty and to pass over the upper dowel bar shuttle at the upper shuttle bar opening when the upper shuttle bar opening is filled with a dowel bar. The feeder includes a plurality of feeding lugs along the single file dowel bar path to load the upper dowel bar shuttle successively with dowel bars for insertion to a slab formed under the dowel bar inserter pan. When the dowel bars are fully inserted, the upper dowel bar shuttle moves relative to the lower dowel bar shuttle. This permits the upper shuttle bar opening in the upper dowel bar shuttle and the lower shuttle bar opening in the lower dowel bar shuttle to move into registration one with another. Dowel bars fall from the upper shuttle bar opening in the upper dowel bar shuttle into the lower shuttle bar opening of the lower dowel bar shuttle through the pan opening in the dowel bar inserter pan and on to a slab formed beneath the dowel bar inserter pan. Thereafter, the dowel bar inserters place the dowel bars centrally of the recently slipformed slab.

DESCRIPTION OF THE SPECIFIC EMBODIMENTS

Figure 1A:
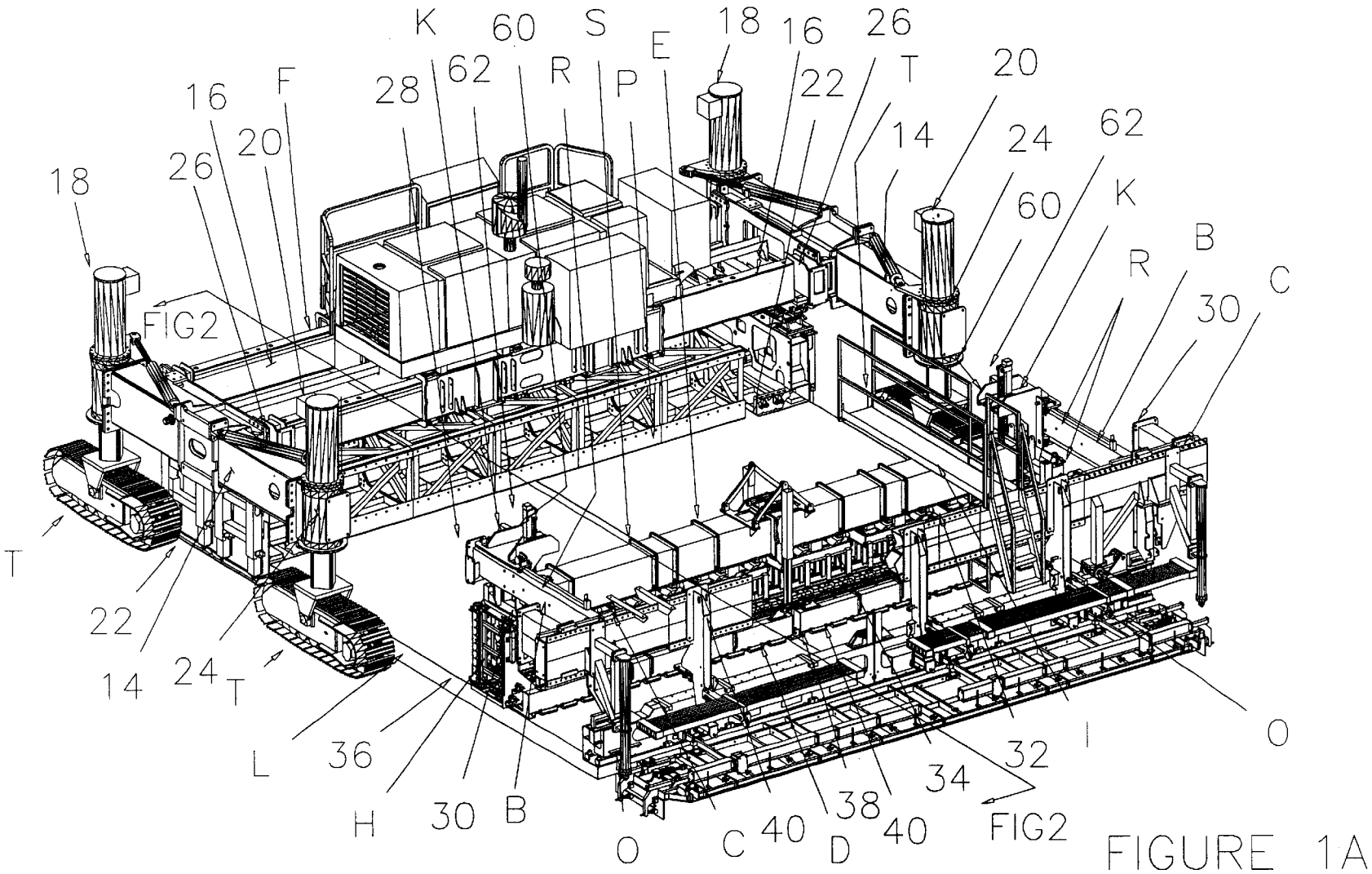
FIG. 1A is a perspective view of a slipform paver in accordance with Guntert et al U.S. Pat. Nos. 5,590,977 and 5,615,972 showing the slipform paver in exploded relationship with respect to the dowel bar inserter kit of this invention.

Referring to FIG. 1A, paver P and dowel bar inserter kit I are shown in exploded relationship. As the full description of the paver is set forth in the referenced patents, only a summary description of paver P will here be provided.

Paver P includes paver bolsters 14, paver cross beams 16, front jacking columns 18 and rear jacking columns 20. Together, paver bolsters 14, paver cross beams 16, front jacking columns 18, and rear jacking columns 20 constitute paver frame F.

Paver P suspends slip form 22 from paver frame F. Finally, paver P must be propelled. Such propulsion comes from four crawler tracks T. The reader will understand that many pavers P only have two crawler tracks. Further, it will be understood that the example of crawler tracks T is exemplary only. All kinds of devices are utilized to propel pavers including tires, rails, cables, sleds and the like. The propulsion referred to in this specification is considered to be generic.

Dowel bar inserter kit I is the novel subject matter of this invention. Dowel bar inserter kit I includes side bolsters B and at least one crossbeam C. These members form a rigid construction enabling the dowel bar inserter kit I to be handled in a unitary manner. The reader will observe that crossbeam C has been broken away in the view of FIG. 1 to enable important working portions of dowel bar inserter kit I to be seen. However that may be, it is important to understand that crossbeam C is unitary, solid member which performs structural reinforcement function when dowel bar inserter kit I is attached to paver P and ties the dowel bar inserter kit I together when it is separated from paver P.

Front jacking columns 18 and rear jacking columns 20 level paver frame F with respect to a level reference system which is here not shown or discussed. What is important to understand is that paver frame F is maintained level in a disposition for paving and that dowel bar inserter kit I must have that same level disposition in order to function properly. Accordingly, attachment of side bolsters B to paver frame F and rear jacking columns 20 will now be set forth.

Paver P requires the addition of four mounting flanges to enable side bolsters B to be attached to paver frame F. Rear jacking column flanges 24 and rear paver cross beam flanges 26 are provided to paver P. Similarly, front frame flange 28 and front jacking column flange 30 are provided to dowel bar inserter kit I. It will thus be seen that each side bolster B is rigidly affixed to paver frame F of paver P and maintains the same disposition of paver P when the required attachment occurs.

It will be realized that in FIG. 1A we do not actually show the required physical attachment; the exploded view is provided for the convenience of the reader so that the kit may readily be distinguished from the paver. It will be understood that during attachment of dowel bar inserter kit I to paver P, hydraulic and electric power is most conveniently provided from paver P to dowel bar inserter kit I. It will therefore be understood that medially of paver P and medially of dowel bar inserter kit I there are respective electrical and hydraulic connections to provide the required power. These conventional connections are not shown and will not hereafter be discussed.

Dowel bar inserter kit I at crossbeam C and side bolsters B travels with paver P. Typical paving speeds can be as high as 15 feet (4.57 M) per minute. In the usual case, a line of dowel bars is required about every 15 feet. Thus, there is a need to rapidly deliver dowel bars to the dowel bar inserters and effect the placement of the dowel bars to the middle of the recently placed slab.

Automated dowel bar insertion was pioneered by Ronald Guntert Sr., the deceased father of Ronald Guntert, the named inventor herein. It is instructive to understand both the geometry and operation of the dowel bar insertion.

Regarding the geometry of dowel bar inserters 32, such inserters are here shown mounted in arrays 34 of four inserters each. Each array 34 attaches to support beam S at and through a vibration isolator (not shown). Further, each array 34 of four inserters each includes three electrically powered vibrators (also not shown).

Presuming that support beam S is stationary with respect to the recently formed slab L, insertion of the dowel bars can be conventionally described. Dowel bar inserter pan D is provided with continuous front member 36, raised rear member 38, and lane spacer members 40 there between. In between lane spacer members 40, there is provided dowel bar insertion apertures 42.

For the brief purpose of explaining the geometry of the dowel bar inserters 32, the reader is asked to consider the case where dowel bars are lying on the freshly formed concrete slab L immediately under dowel bar inserters 32 array 34. All that is required is that support beam S be lowered and array 34 of dowel bar inserters 32 be vibrated. When this occurs, dowel bars are inserted to the mid point of freshly formed slab L. The exact matter of placement of dowel bars to the slab L will later be made clear with respect to FIGS. 3A, 3B and 3C.

Dowel bar insertion has an effect on the freshly slip formed slab L. Simply stated both the added mass of the dowel bar and the vibration of dowel bar inserters 32 causes the surface of slab L to raise (or to be displaced) above that of the finished slab as it comes from slipform 22 on paver P. Thus, raised rear member 38 of dowel bar inserter pan D enables this raised (or displaced) portion of the concrete to freely pass out through the back of the dowel bar inserter pan D. As will hereafter be pointed out, dowel bar inserter kit I includes oscillating correcting beam O. This oscillating correcting beam O causes the raised portion of slab L overlying each dowel bar to be re-finished even with the remainder of the slab L. Further, dowel bar inserter kit I is supplied with its own side forms. These side forms confine the plastic concrete slab at the edges during dowel bar insertion. For convenience of transport, the side forms hinge upward during transport.

Second, however, it will be remembered that paver P and its attached dowel bar inserter kit I is continuously moving at a rate up to about 15 feet (4.57 M) per minute placing slip formed slab L. Thus there is a need that during insertion that array 34 of dowel bar inserter forks 32 remain stationary with respect to the slipformed slab L. Rails R on side bolsters B and cars K supporting support beam S at either end provide this function.

Side bolsters B are provided with rails R. Cars K ride on rails R towards and away from paver P. When cars K move away from paver P, cars K may be held stationary with respect to recently slipformed slab L even though paver P proceeds continuously in the forward direction at a relative speed of up to 15 feet (4.57 M) per minute. It will be understood that the "down cycle" of array 34 of dowel bar inserter forks 32 is in the order of 7 seconds. Further, dwell time at the full depth of insertion is about 3 seconds. Finally the "up cycle" of the array 34 of dowel bar inserter forks 32 is about 5 seconds. Thus a total excursion of cars K on crawler tracks T of side bolsters B in the order of 3.75 feet is required.

Figure 1B:
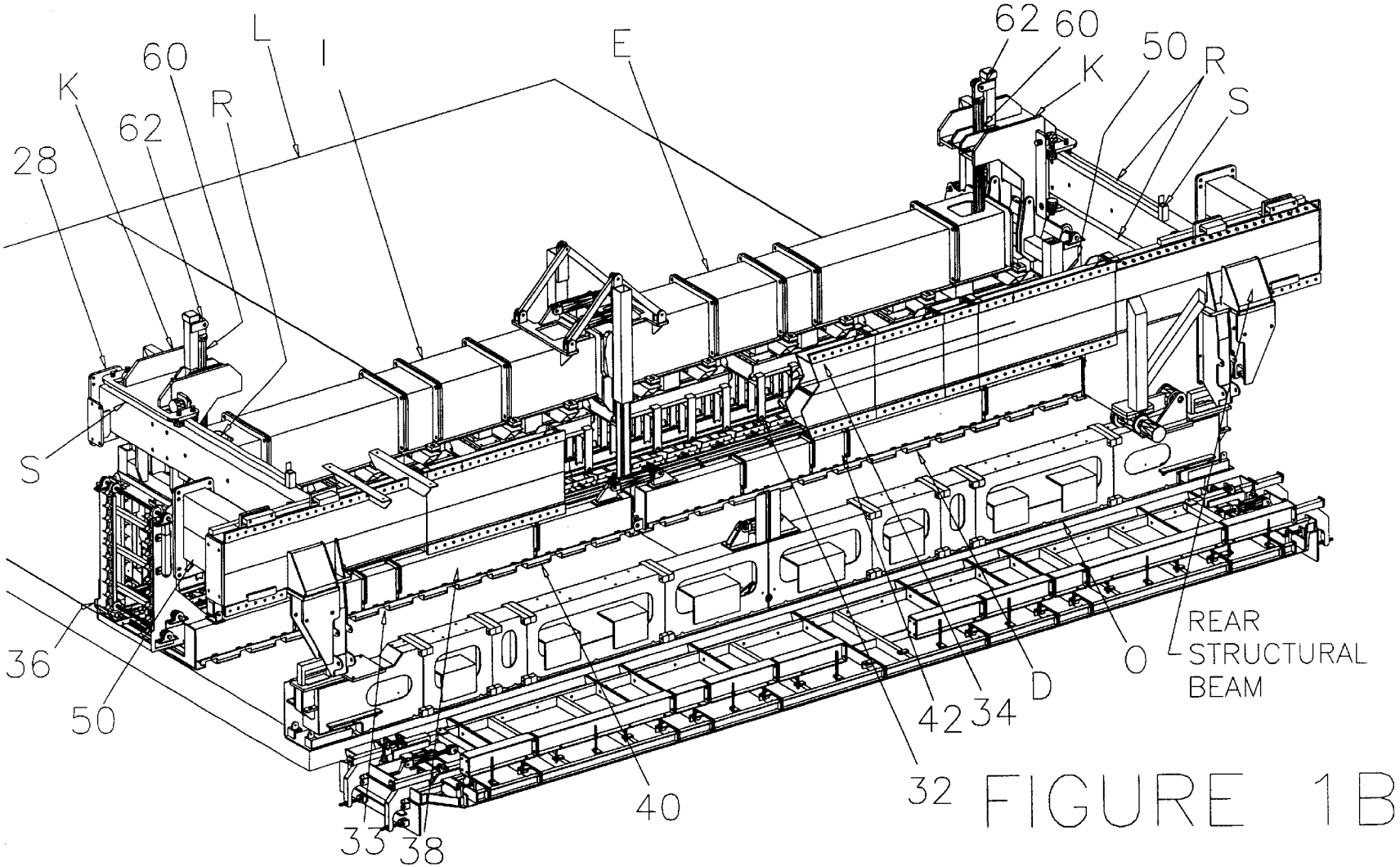
FIG. 1B is a partial perspective view of the dowel bar inserter kit showing the side bolsters, bolster tracks, the dowel bar inserter supporting cars, the dowel bar inserters, dowel bar inserter pan, the trailing oscillating screed, trailing sideforms and supports and the finishing pan.
Figure 1C:
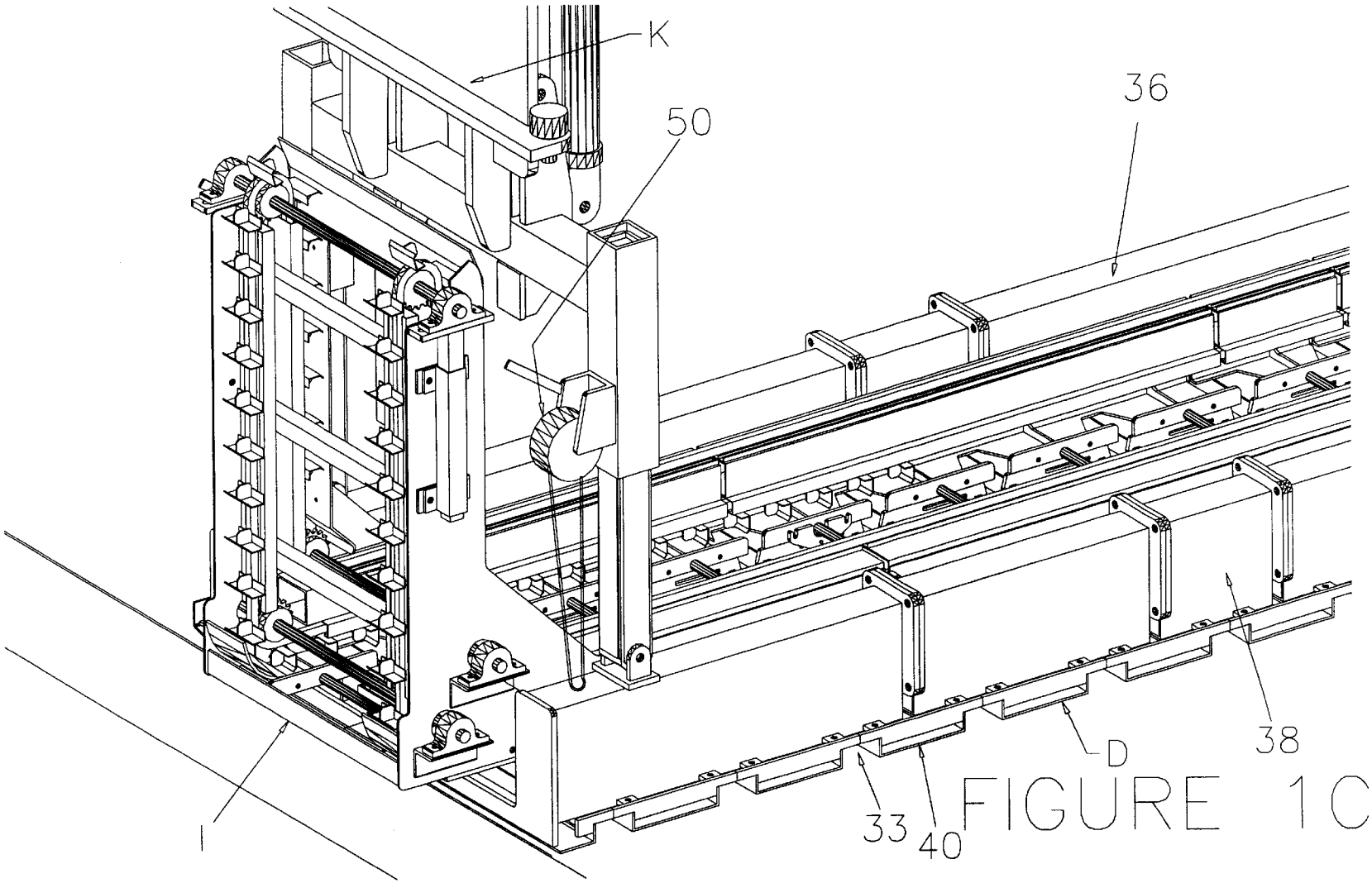
FIG. 1C is a partial perspective of the dowel bar inserter illustrating the deposit of the dowel bars into the upper dowel bar inserter; the dowel bars being readied for registration for insertion into the concrete slab.
Figure 2:
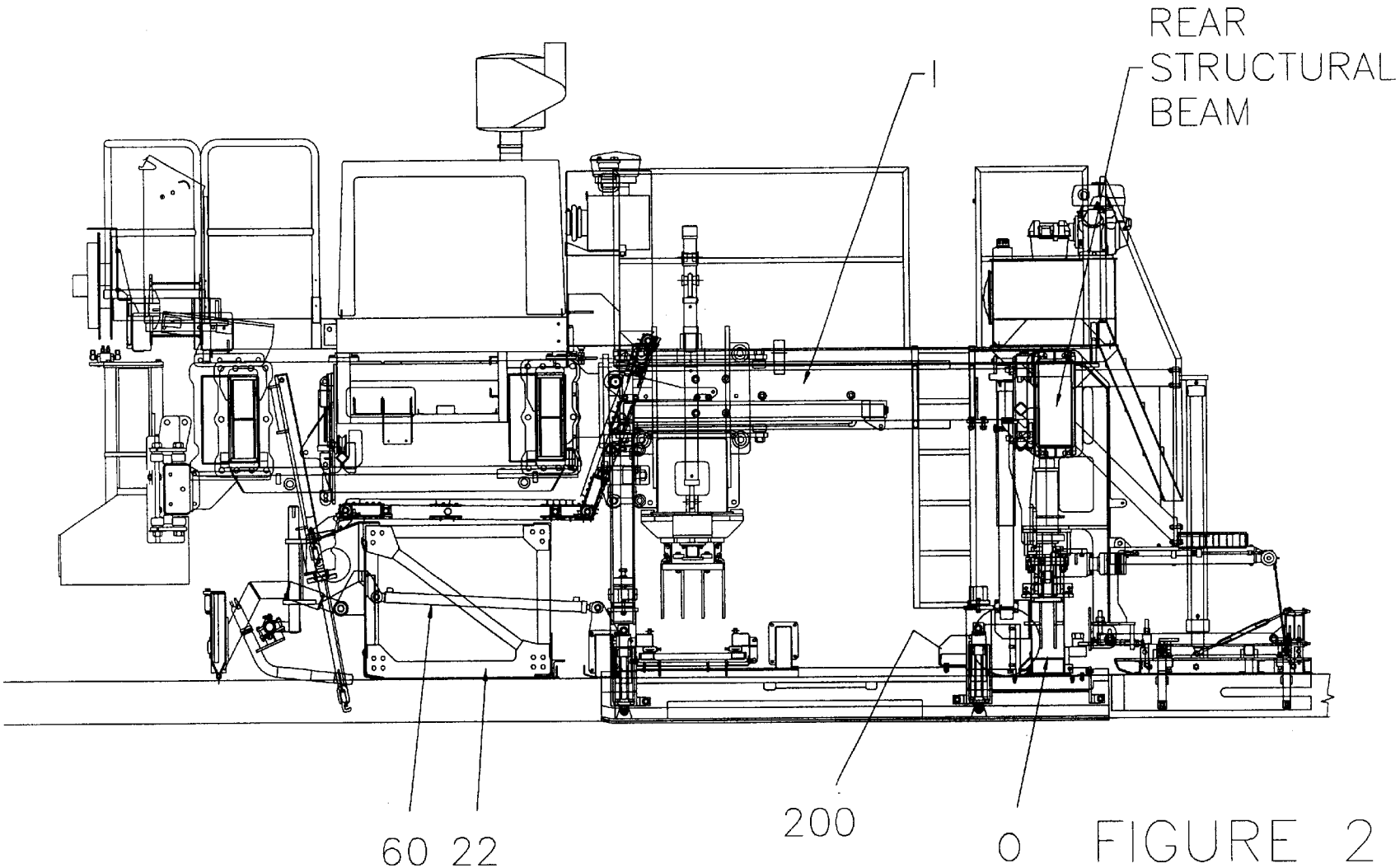
FIG. 2 is a cross-section taken along lines 2—2 of FIG. 1A illustrating the attached dowel bar inserter kit and paver.

Referring first to FIGS. 1B and 1C to understand the suspension of dowel bar inserter pan D and thereafter to FIG. 2, understanding of the movement of support beam S can be illustrated. Referring to FIGS. 1B and 1C, it will be seen that dowel bar inserter pan D is supported from cars K utilizing winches 50 and paired side telescoping members 52, 54, and central telescoping member 56. Support of dowel bar inserter pan D can easily be summarized. For the most part, dowel bar inserter pan D is supported by floating on freshly formed concrete slab L. Winches 50 adjust from cars K the total amount of weight of dowel bar inserter pan D on the concrete to prevent it from sinking or plowing and allow it to be raised up out of the way which is required when starting to pave. Further, and where super-elevation is encountered as in turns on modern roadways, weight distribution of dowel bar inserter pan D can be varied utilizing winches 50.

At the same time, it is necessary that dowel bar inserter pan D maintain its alignment with respect to support beam S. In this regard, paired side telescoping members 52, 54 and central telescoping member 56 maintain the required alignment with respect to cars K and support beam S.

During the insertion cycle, it is necessary that dowel bar inserter pan D remain stationary with respect to the freshly slip formed concrete slab L. Referring to FIG. 2, dowel bar inserter pan hydraulic cylinders 60 enable this controlled movement to occur. When it is desired to have dowel bar inserter pan D remain stationary with respect to slab L, dowel bar inserter pan hydraulic cylinders 60 are allowed to open freely against the weight of dowel bar inserter pan D resting on slab L. When dowel bar inserter forks have been completely withdrawn (and cleared the top of concrete) and it is desired to retrieve dowel bar inserter pan D, these cylinders are closed. In such closure, they cause the dowel bar inserter pan D to be gathered (retracted or recalled) to the paver P, while the dowel bars are left in place.

Having set forth the need for support beam S to remain stationary with respect to slab L, the up and down movement of support beam S from cars K can now be discussed. Each car K includes a hydraulic cylinder mounting clevis 46. A support beam S hydraulic cylinder 44 attaches at an upper end to hydraulic cylinder mounting clevis 46 and at a lower end to beam clevis 48 (not shown). It is clear that with simultaneous expansion and contraction of support beam hydraulic cylinders 44, support beam S is lowered and raised from freshly slipformed slab L. Assuming that array 34 of dowel bar inserter forks 32 is maintained stationary with respect to slab L, it is equally apparent that dowel bar inserter forks 32 may insert and vibrate dowel bars in their path into slab L.

Referring to FIG. 2, chain feeders for tie bar inserters 62 are known. In such chain feeders for tie bar inserters 62, tie bars a conventionally conveyed on top of the chain feeder, and individually fed to a tie bar inserter 64. This type of feeding is to be contrasted with the chain feeding here required. An illustration of the chain feeding here required and the problems to be solved can be best seen with respect to FIGS. 1A and 6.

Figure 6:
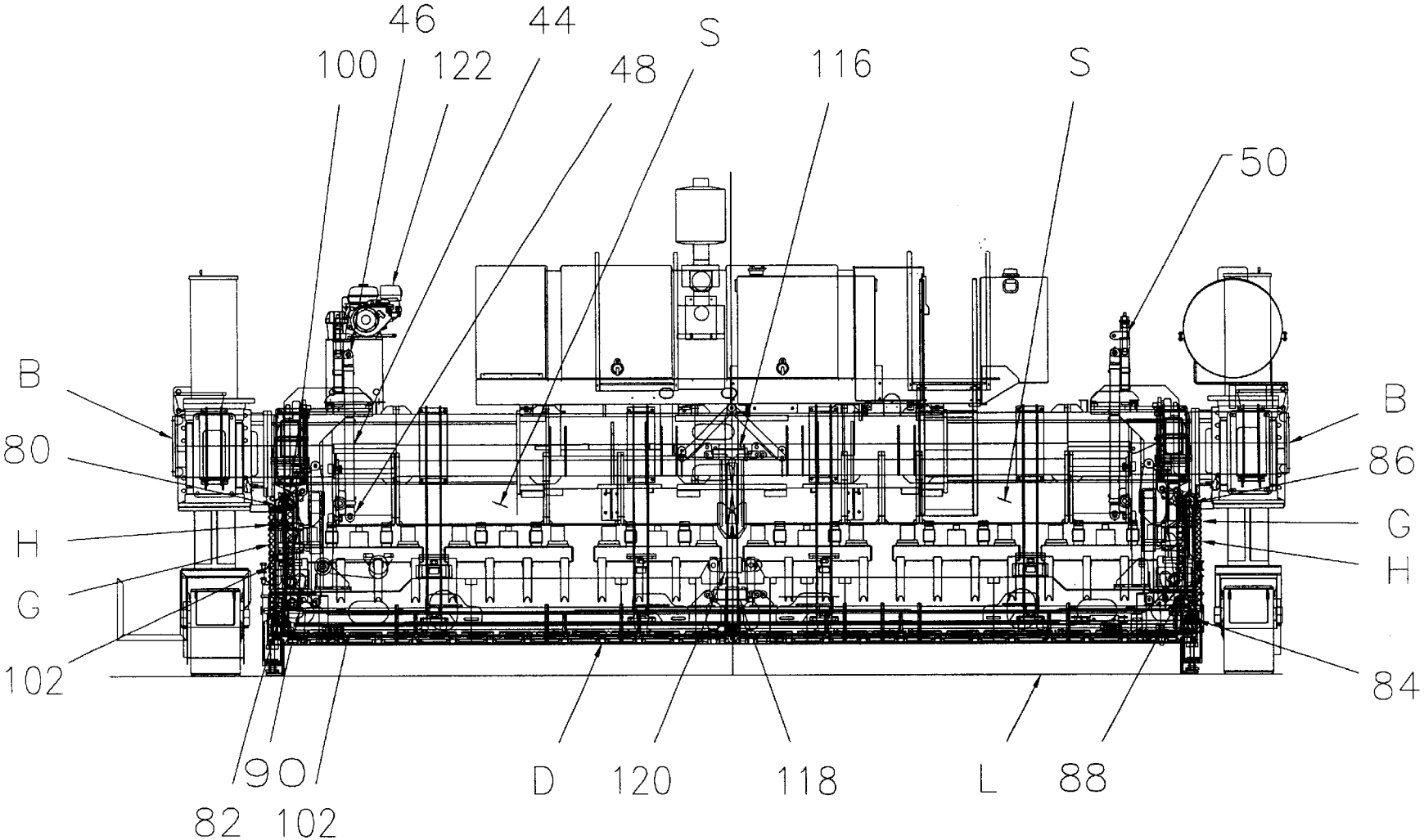

Contrast this illustration with tie bar chain feeder H illustrated in FIG. 6.

First, because tie bar dowel bar chain feeder H must pass around and under dowel bar inserter forks 32, the chain is required to be disposed in a "U" shaped configuration. Since the chain is disposed in a "U" shaped configuration, dispensing of the conveyed dowel bars must occur from the bottom of dowel bar chain feeder H rather than the top of dowel bar chain feeder H.

Second, and remembering the dowel bar distributing car of the prior art, it has been found highly important to keep the profile of the tie bar dowel bar chain feeder H within the path of crawler tracks T. This enables the stroke of cars K, support beam S, and dowel bar inserters 32 to pass between crawler tracks T. If this passage were not possible, side bolsters B of paver frame F would have to be sufficiently long so that crawler tracks T would allow a stationary placement of dowel bar inserter forks 32 without interference from crawler tracks T.

Further, in the prior art where a dowel bar distributing cart has been utilized, it is not possible to begin tie bar dowel bar insertion while the cart is overlying dowel bar inserter forks 32. Thus, when the cart is distributing dowel bars and also when the car is returning from distributing tie bars dowel bars, no insertion of the tie bar dowel bars can occur. As will hereafter be developed, with the dowel bar chain feeder H of this invention, return of the chain can occur during dowel bar insertion. This return of the chain readies the chain for loading and improves cycle time, an improvement that is critical given the speed of modern slipform pavers.

Have set forth the problems that relate to dowel bar chain feeder H, its design may now be discussed. This design may be best understood with respect to the cartoon series of FIGS. 3A, 3B, and 3C, keeping in mind the full cross section of dowel bar chain feeder H illustrated in FIG. 6.

First, and referring to FIG. 6, chain 70 of dowel bar chain feeder H is disposed in an endless "U" shaped loop. This endless "U" shaped loop is required so that chain 70 can pass around dowel bar inserter forks 32.

Figure 3A:
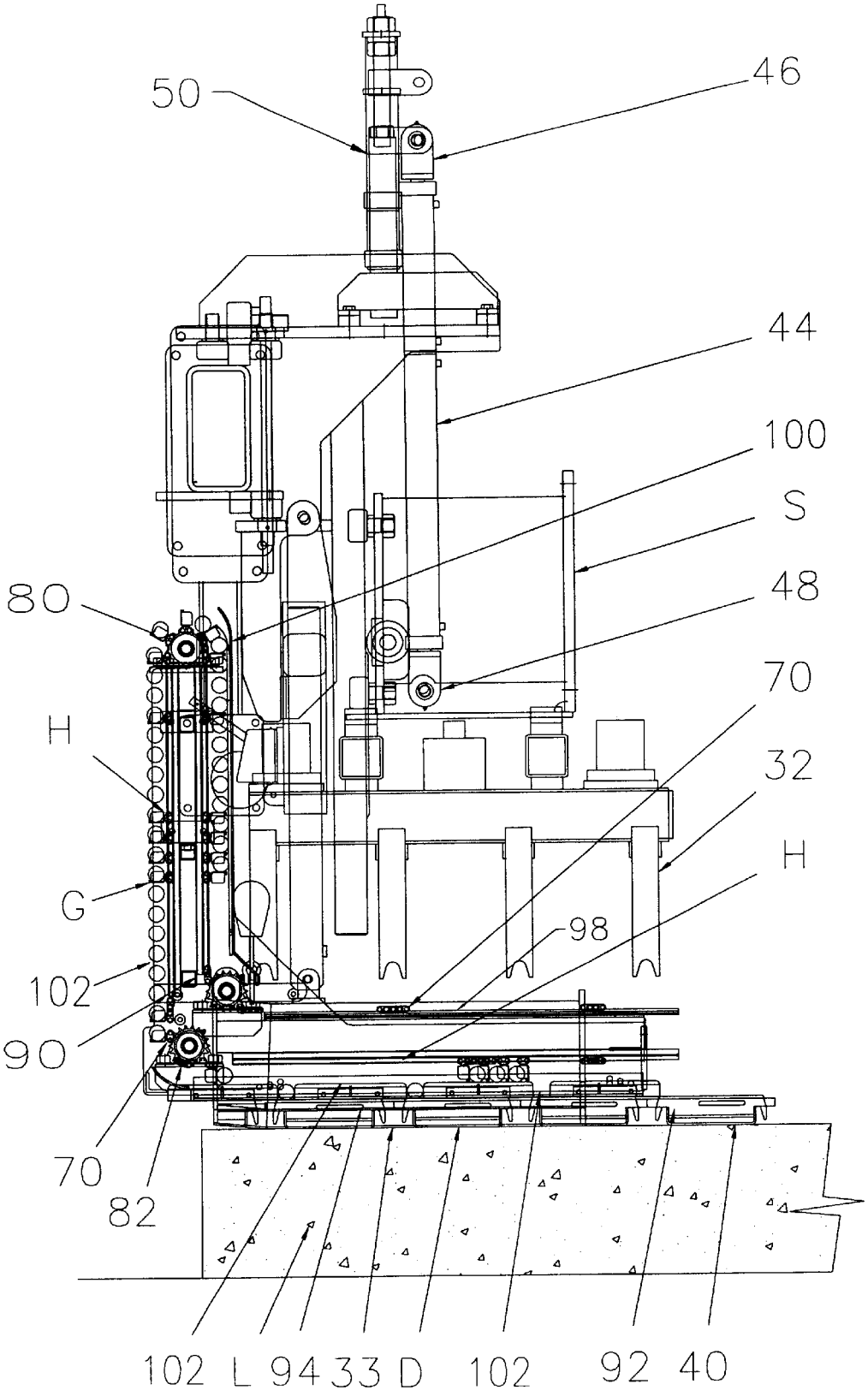
FIGS. 3A, 3B and 3C are a side elevation cross section illustrating dowel bar placement with, FIG. 3A illustrating the placement of the dowel bars to the upper shuttle bars by the chain feeder of this invention, FIG. 3B illustrating the reciprocation of the upper shuttle bars relative to the lower shuttle bars with vertical movement of the inserters immediately overlying the placed dowel bars, and, finally FIG. 3C illustrating the placement of the dowel bars to the mid point of the newly placed slipformed slab.

Second, and referring to FIG. 3A, it will be seen that chain 70 has L-shaped lugs G attached at the outside of the endless loop. In order to dispose the chain in an "U" shape, sprockets 80, 82, 84, 86, 88 and 90 are required. Remembering that "L" shaped lugs G are disposed on the outside of chain 70, it can immediately be seen that "L" shaped lugs G cannot pass around sprockets 88, and 90. Thus it is required that chain 70 in effect "reciprocate" on its endless loop.

Third, "L" shaped lugs G are affixed to chain 70 in relatively closely spaced spatial relationship. Successive placed dowel bars are given on that required interval between "L" shaped lugs G that enables the dowel bars to be successively placed onto dowel bar chain feeder H. This much can be seen with respect to FIGS. 6 and 3A.

Having set forth these general parameters, operation of dowel bar chain feeder H will now be discussed. It will include first a description of dowel bar inserter pan D and the apparatus supported on it that enables collection of the dowel bars and deposit of the dowel bars to the freshly slipformed slab L. Thereafter, operation will be set forth with respect to the cartoon series of FIGS. 3A, 3B and 3C.

Referring to FIG. 1C, an expanded view of dowel bar inserter pan D is shown. Three important elements are shown which are supported on dowel bar inserter pan D. First, at each dowel bar inserter forks 32, dowel bar inserter pan D defines a dowel bar pan aperture 33 which is bounded by continuous front member 36, lane spacer members 40, and raised rear member 38. Overlying each of these apertures there is placed lower shuttle bar 92 having lower shuttle bar slot 94. A dowel bar placed in lower shuttle bar slot 94 falls through dowel bar pan aperture 33 and onto the recently slip formed slab L. It should be noted that lower shuttle bar slot 94 is of such a dimension that any dowel bar placed within the lower shuttle bar slot 94, will fall through to the slab. It is not required that lower shuttle bar slot 94 have the same dimension as the dowel bar being utilized. The lower shuttle bar slot 94 is sized to allow the maximum diameter dowel bar ever to be utilized on the dowel bar inserter kit to pass. The lower shuttle bar slot 94 simply acts as a guide for the dowel bar.

Fitted in sliding relationship on top of lower shuttle bar 92 is upper shuttle bar 96. Like lower shuttle bar 92 at lower shuttle bar slot 94, upper shuttle bar 96 defines upper shuttle bar slot 98. It is important to note that this upper shuttle bar height and slot 98 must have at least the same dimension as the diameter of the particular dowel bar being utilized. As will hereafter become more apparent, if upper shuttle bar slot 98 has a dimension exceeding that of the dowel bar, possible jamming of dowel bar chain feeder H can occur relative to upper shuttle bar 96 and upper shuttle bar slot 98.

Referring to FIG. 3A, it will be seen that lower shuttle bar 92 at lower shuttle bar slot 94 is offset with respect to upper shuttle bar 96 at upper shuttle bar slot 98. Presuming, that this upper shuttle bar slot 98 is empty of a dowel bar, loading of such a dowel bar can be readily understood with respect to FIG. 3A.

Observing FIG. 3A, it will be understood that an operator has loaded "L"-shaped lugs G with dowel bars. These "L"-shaped lugs G will be seen to be closely spaced. Further, it will be remembered that dowel bar chain feeder H may be required to contain as many as fifty (50) dowel bars. This being the case, at sprockets 80 there is defined toward the center of paver P magazine wall 100. Excess bars travel over the top of sprockets 80 are confined to tie bar dowel bar chain feeder H by magazine wall 100.

Presuming that dowel bar chain feeder H at "L"-shaped lugs G is fully loaded with dowel bars, the endless loop of tie bar chain feeder H is rotated counterclockwise with respect to FIG. 3A. Dowel bars proceed along single file dowel bar path 102. In passage along single file dowel bar path 102, "L"-shaped lugs G push the respective dowel bars in their path parallel to the openings in upper shuttle bar slot 98 within upper shuttle bar 96. Initially, upper shuttle bar 96 is offset with respect to lower shuttle bar 92 so that the respective upper shuttle bar slot 98 does not align itself with respect to lower shuttle bar slot 94.

Understanding this much, the first upper shuttle bar slot 98 will be loaded with a dowel bar. The question then becomes what happens when a second dowel bar approaches the upper shuttle bar slot 98 which has now been loaded with a dowel bar. The answer is that the dowel bar skips over the already filled upper shuttle bar slot 98! The dowel bar then proceeds to the next empty upper shuttle bar slot 98. Thus, the dowel bar chain feeder H serves to sequentially load all upper shuttle bar slots 98 in all upper shuttle bars 96. This much occurs in FIG. 3A.

Figure 3B:
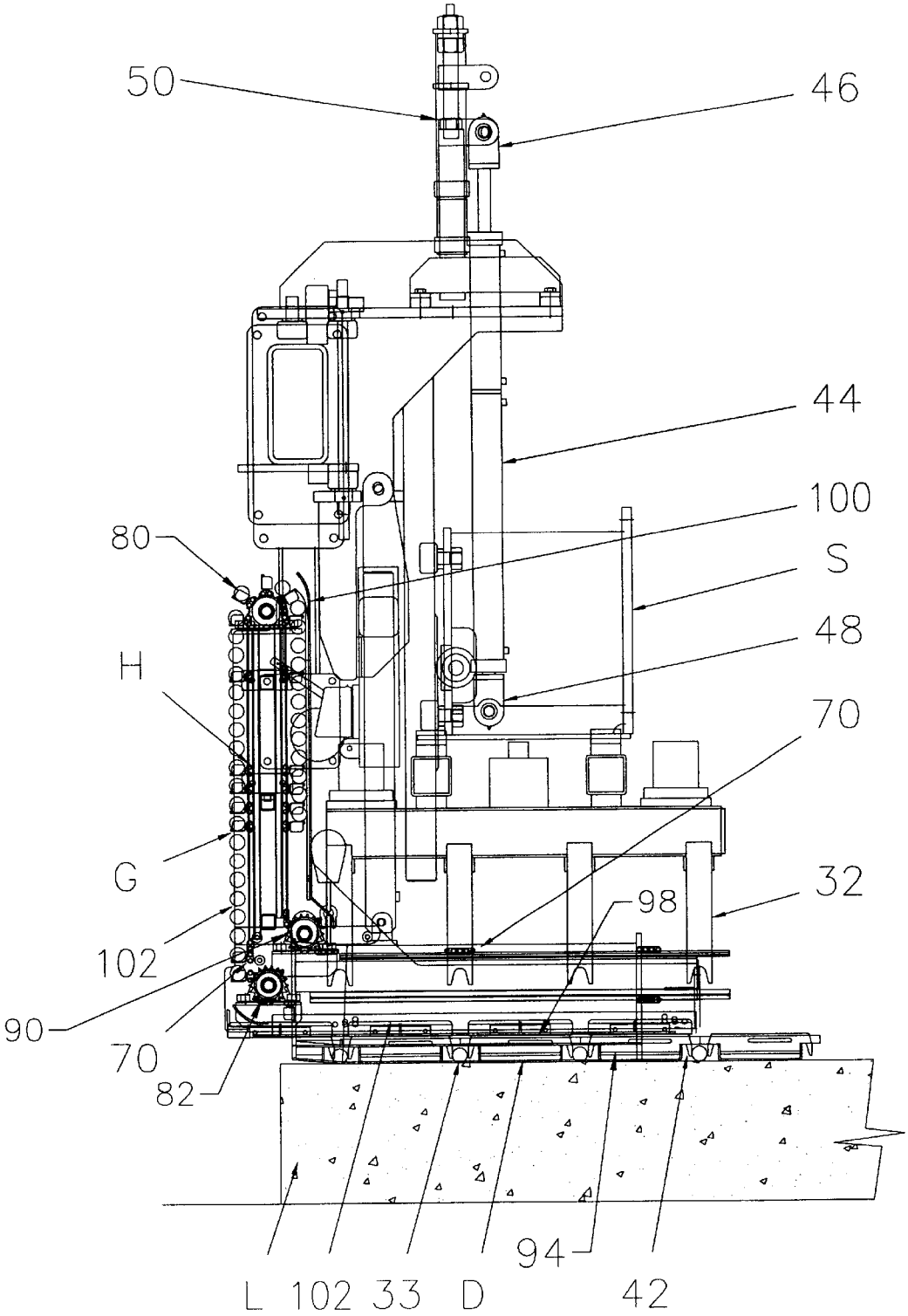

Referring to FIG. 3B, and when all upper shuttle bar slots 98 are loaded with dowel bars, upper shuttle bar 96 reciprocates (by means of a hydraulic cylinder) relative to lower shuttle bar 92. This reciprocation occurs until registration occurs between upper shuttle bar slot 98 and lower shuttle bar slot 94. When such registration occurs, all dowel bars fall to recently slipformed slab L.

Looking further at FIG. 3B, two observations can be made. First, dowel bar inserter forks 32 have moved downward to the "ready" position. Once the dowel bar inserter forks are in this "ready" position one simply has to wait until the dowel bar inserter pan D centers over the location along the slab where dowels must be inserted. Once this point is reached, the dowel bar inserter can be manually or automatically stopped there and the towing cylinders 60 go into the free-float mode. The support cars K, support beam S with dowel bar inserters and dowel bar inserter pan D stop at the location of the joint while the paver continues ahead. As soon as the dowel bar inserter stops over the location of the joint the vibrators have been turned on and dowel bars are ready for insertion to the recently slip formed slab L. Second, the dowel bar chain feeder H can be reversed in its path to a clockwise motion as soon as the bars are loaded across the width of the dowel bar inserter pan even during the insertion operation. Once the "L" shaped lugs G are back to the loading position, reloading of dowel bar chain feeder H can occur. This is to be compared to the prior art cart dowel bar distribution method where the cart would have to be completely evacuated and returned to the loading position before an insertion could begin. Once the dowel bar inserter forks 32 have cleared the top of the recently slip formed slab L, the recall cylinders can retract the dowel bar inserter to its original position at the back of the slipformn paving kit.

Figure 3C:
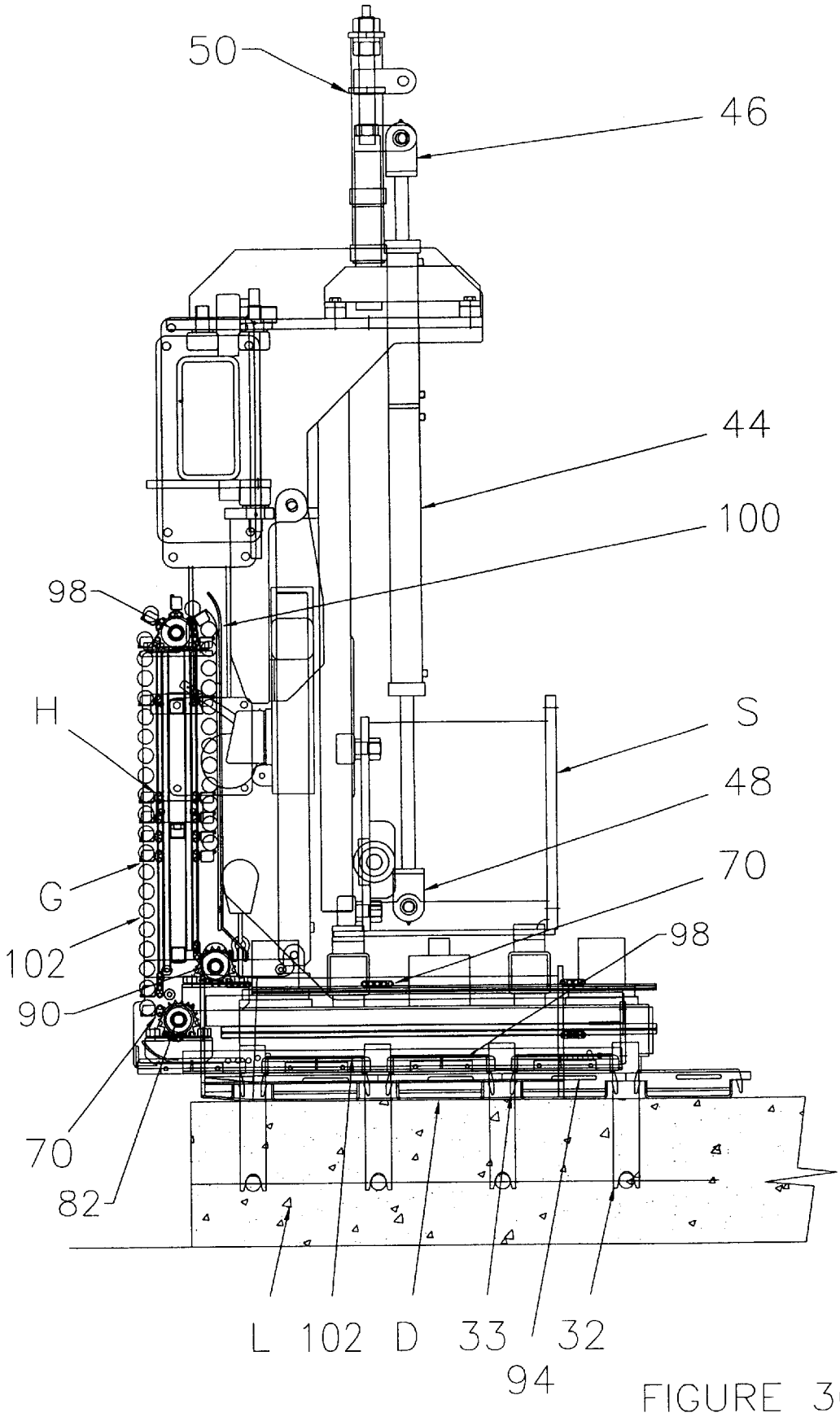

Finally, reference is made to FIG. 3C. In this Figure, dowel bar inserter forks 32 have made full insertion in and out of the slab L. Dowel bar placement is complete. At the same time this occurs, loading of tie bar chain feeder H can begin to occur.

Referring to the expanded views of FIGS. 3A and 3B, it will be noted that lower shuttle bar 92 is provided with lower shuttle bar slot 104. Upper shuttle bar 96 has inverted triangular section 106 fastened at its side. Inverted triangular section 106 includes a protruding pawl 108 which fits into lower shuttle bar slot 104. This respective protruding pawl 108 and lower shuttle bar slot 104 cause upper shuttle bar 96 and lower shuttle bar 92 to remain in close relation during the sliding movement. There is a reason for this fastening of the relatively reciprocating upper shuttle bar 96 and lower shuttle bar 92 in close relation.

In the prior art it has been found that lower shuttle bar 92 and upper shuttle bar 96 can separate. And when such separation occurs, dowel bars become jammed into the interface between lower shuttle bar 92 and upper shuttle bar 96. By the expedient of fastening these members in relatively close sliding relationship, such separation and jamming is avoided.

Returning to FIG. 1A, will be noticed that dowel bar inserter kit I is separated from paver P. Proceeding onto FIGS. 4 and 5, it can be readily understood how this separation can be used to enable ready transport of dowel bar inserter kit I free and clear of paver P.

Figure 4:
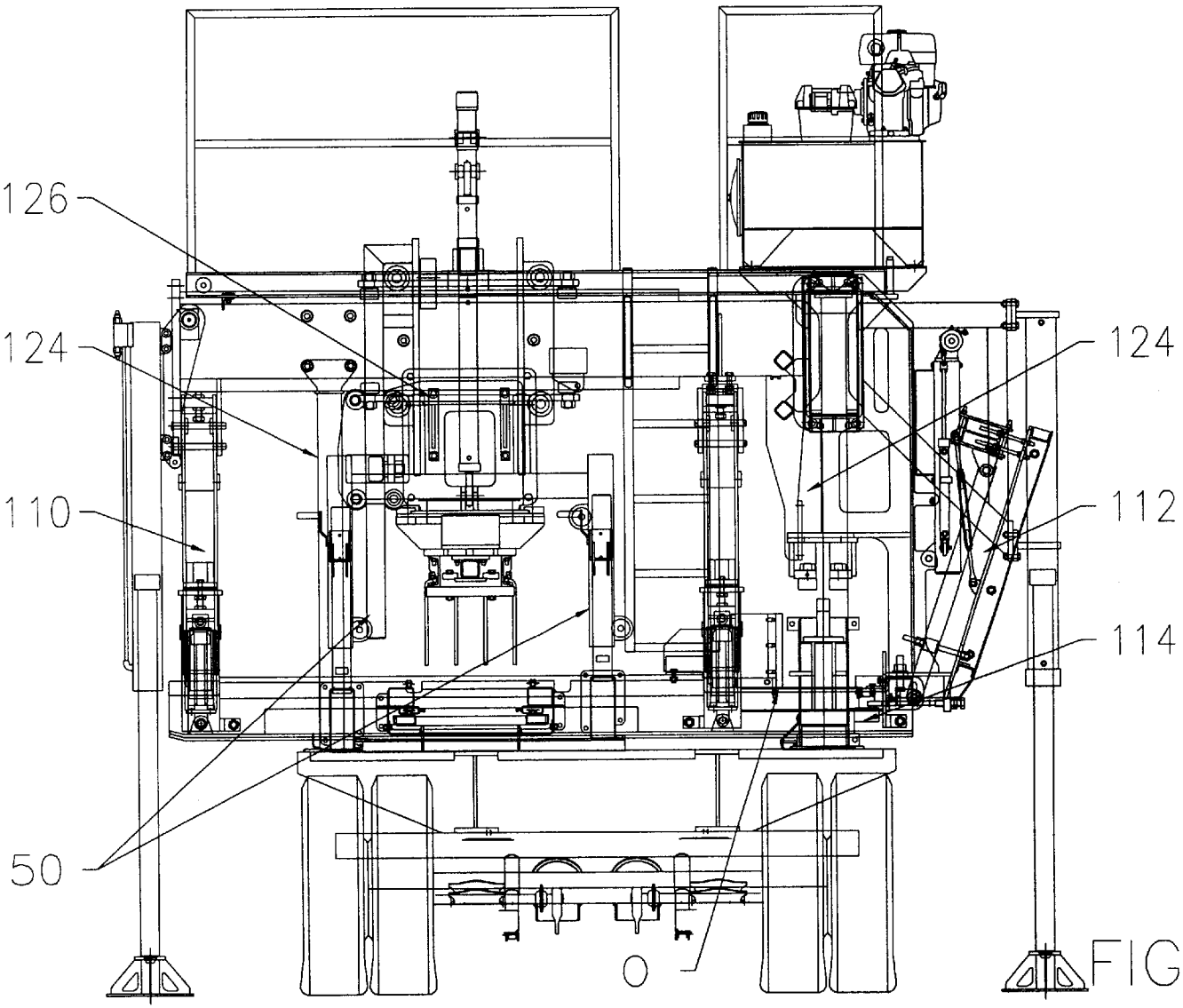
FIG. 4 illustrates the dowel bar inserter kit of FIG. 1 detached from the paver and elevated with the aid of attached supporting cylinders and a transporting flatbed truck placed under the dowel bar inserter kit for transport.
Figure 5:
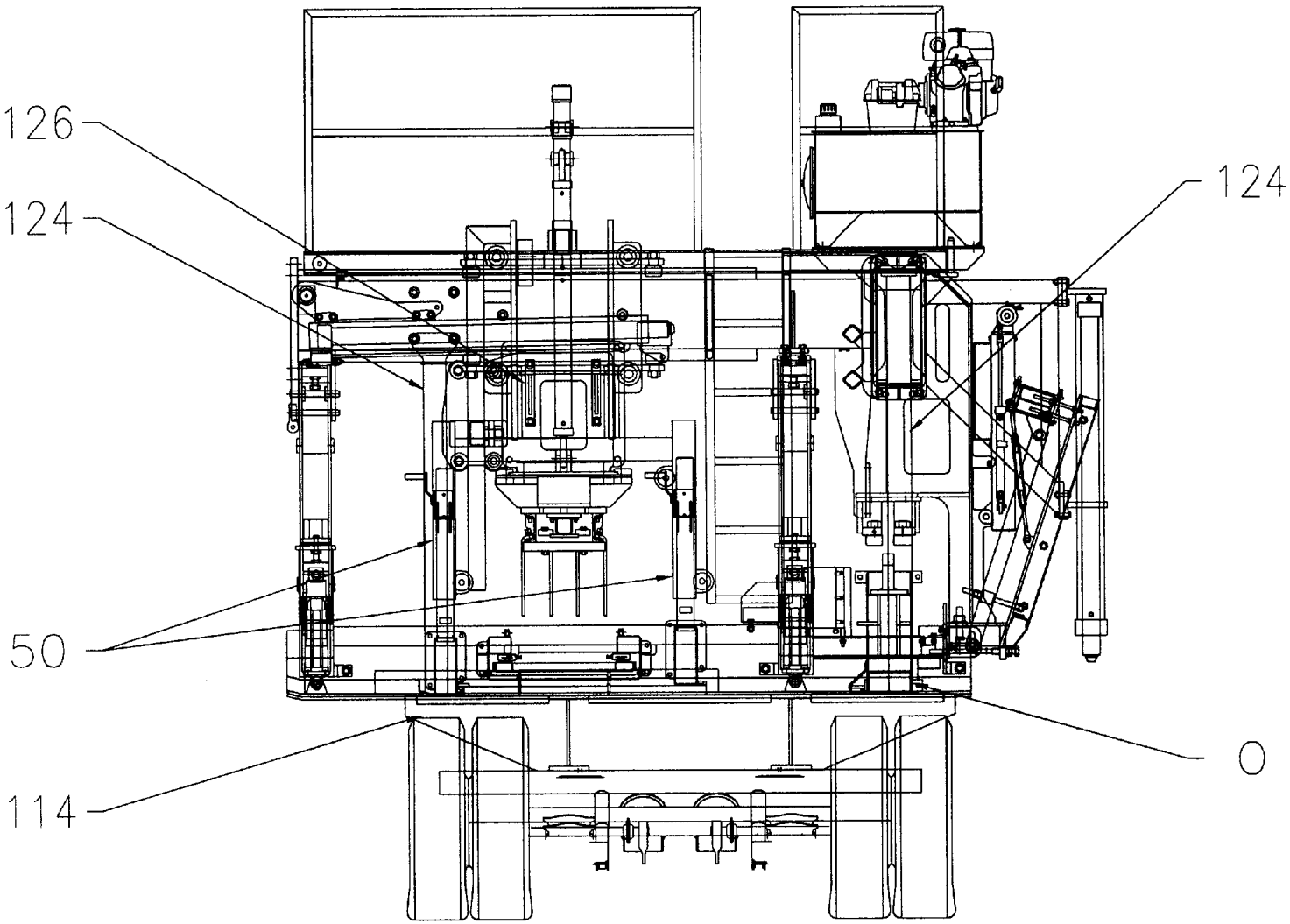
FIG. 5 illustrates the supporting cylinders retracted with the dowel bar inserter kit readied for transport; and, FIG. 6 is an end elevation of the dowel bar inserter kit illustrating the path of the dowel bar inserter feeder around the dowel bar inserters.

Referring to FIG. 4, it will be seen that dowel bar inserter kit I is provided with paver side hydraulic lift cylinders 110 and finishing pan side hydraulic lift cylinders 112. Before dowel bar inserter kit I is detached in the exploded mode shown in FIG. 1A, these respective cylinders are deployed along with shipping stands 124 so that dowel bar inserter kit I can stand independently of paver P. At the same time, support beam S is fastened to side bolsters at insertion beam lock 126. This fastening produces a rectilinear beam structure consisting of bolsters B, support beam S, and crossbeam C.

Typically, an independent hydraulic unit 122 powers both paver side hydraulic lift cylinders 110 and finishing pan side hydraulic lift cylinders 112. When dowel bar inserter kit I is supported on the cylinders, all parts of the dowel bar inserter kit including dowel bar inserter pan D are raised above the level of flatbed trailer 114. Thereafter, flatbed 114 is backed under dowel bar inserter kit I and finishing pan side hydraulic lift cylinders 112 and paver side hydraulic lift cylinders 110 lowered to place dowel bar inserter kit I on flatbed 114 with support to the flatbed 114 at shipping stands 124. Thereafter, and referring to FIG. 5, the respective cylinders 110 and 114 are retracted and transport of dowel bar inserter kit I occurs.

Referring to FIG. 6, the reader having familiarity with the art will understand that it is often cylinders to place a "crown" or "roof top profile" within a paved slab to aid in drainage. It will be seen that with respect to support beam S, oscillating correcting beam O, and dowel bar inserter pan D, provision is made centrally of each of the beams to contract the respective beams medially at support beam crowning joint 116, oscillating correcting beam crowning joint 118, and dowel bar inserter pan crowning joint 120. Such crowning occurs by expansion and contraction of a hydraulic cylinder between a central pivot. As can be understood, suspension of support beam S on support beam hydraulic cylinders 44 enables both the support beam B and the dowel bar inserter pan D to adapt to such a crown. Further, oscillating correcting beam O is provided with a similar support.

What is claimed is:

1. A plurality of dowel bar inserter stations, each dowel bar insertion station comprising:

an upper dowel bar shuttle with an upper shuttle bar opening for receiving a dowel bar;

a dowel bar inserter pan for forming concrete adjacent dowel bar insertion stations;

a lower dowel bar shuttle with a lower shuttle bar opening through the dowel bar inserter pan for permitting a dowel bar to fall through the lower dowel bar shuttle and the dowel bar inserter pan;

a single file dowel bar path defined immediately above the plurality of dowel bar inserter stations at the upper dowel bar shuttle for each inserter station;

means for moving dowel bars single file along the single file dowel bar path to allow dowel bars to fall into the upper dowel bar shuttle;

means for moving the upper dowel bar shuttle relative to the lower dowel bar shuttle to permit the upper shuttle bar opening in the upper dowel bar shuttle and the lower shuttle bar opening in the lower dowel bar shuttle to move into and out of registration one with another to permit dowel bars to fall from the upper shuttle bar opening in the upper dowel bar shuttle into the lower shuttle bar opening of the lower dowel bar shuttle and on to a slab formed beneath the dowel bar inserter pan; and, a dowel bar inserter for moving a dowel bar into the slab.

2. The plurality of dowel bar inserter stations according to claim 1 and wherein:

the pan opening of the dowel bar inserter pan is closed on all sides.

3. The plurality of dowel bar inserter stations according to claim 1 and wherein:

the lower shuttle bar opening has a dimension larger than a diameter of the dowel bar to permit dowel bars of many sizes to pass through the lower shuttle bar.

4. The plurality of dowel bar inserter stations according to claim 1 and wherein:

the upper shuttle bar opening has a dimension chosen to correspond to a diameter of the dowel bar.

5. The plurality of dowel bar inserter stations according to claim 1 and wherein:

the means for moving dowel bars single file along the single file dowel bar path comprises:

a feeder including a plurality of feeding lugs for pushing dowel bars along the single file dowel bar path parallel to openings in the upper dowel bar shuttle to enable dowel bars to fall into the upper dowel bar shuttle when the upper dowel bar shuttle is empty at the upper shuttle bar opening of a dowel bar and to pass over the upper dowel bar shuttle at the upper shuttle bar opening when the upper shuttle bar opening is filled with a dowel bar; and, means for moving the feeder including the plurality of feeding lugs along the single file dowel bar path to load the upper dowel bar shuttle successively with dowel bars for insertion to a slab formed under the dowel bar inserter pan.

6. The plurality of dowel bar inserter stations according to claim 5 and wherein:

the feeder includes a substantially horizontal portion for distributing dowel bars to the upper shuttle bar opening and a substantially vertical portion for being loaded with dowel bars.

7. The plurality of dowel bar inserter stations according to claim 6 and wherein:

the substantially vertical portion of the feeder includes a magazine for retaining dowel bars to the lugs.

8. The plurality of dowel bar inserter stations according to claim 5 and wherein:

the lugs are "L" shaped as disposed from the feeder.

9. The plurality of dowel bar inserter stations according to claim 8 and wherein:

the feeder includes a horizontal section for distributing dowel bars to the upper shuttle bar opening and a vertical section for loading dowel bars to the "L" shaped lugs; and, the "L" shaped lugs receive and retain the dowel bars on the vertical section and push the dowel bars on the horizontal section.

10. The plurality of dowel bar inserter stations according to claim 5 and wherein:

the feeder is a chain feeder.

11. The plurality of dowel bar inserter stations according to claim 5 and wherein:

the feeder is disposed in an endless loop.

12. The plurality of dowel bar inserter stations according to claim 5 and wherein:

the means for moving dowel bars single file along the single file dowel bar path comprises: and wherein the feeder includes a plurality of lugs for pushing each dowel bar.

13. The plurality of dowel bar inserter stations according to claim 5 and wherein:

the feeder has a spacing between successive lugs which is less than the spacing between the upper shuttle bar openings of the plurality of dowel bar inserter stations.

14. The plurality of dowel bar inserter stations according to claim 5 and wherein:

the plurality of feeding lugs contact the dowel bars on or below the centerline of the dowel bars.

* * * * *